United States Patent [19]

Gilfillan

[11] Patent Number: 5,029,852

[45] Date of Patent: Jul. 9, 1991

[54] BAT SWING GUIDE APPARATUS

[76] Inventor: George Gilfillan, 38768 Old 80, Boulevard, Calif. 92005

[21] Appl. No.: 541,307

[22] Filed: Jun. 21, 1990

[51] Int. Cl.[5] ..... A63B 69/40

[52] U.S. Cl. ..... 273/26 R

[58] Field of Search ..... 273/26 R, 29 A, 191 R

[56] References Cited

U.S. PATENT DOCUMENTS

| | | | |
|---|---|---|---|
| 2,985,452 | 5/1961 | Trippet | 273/26 R |
| 3,482,838 | 12/1969 | Gibson et al. | 273/191 R |
| 3,711,103 | 1/1973 | Seltzer | 273/191 R |
| 3,904,199 | 9/1975 | Burchett | 273/26 R |
| 3,940,131 | 2/1976 | Claire, Jr. | 273/26 R |
| 4,105,203 | 8/1978 | Cho | 273/29 A |
| 4,105,204 | 8/1978 | Koenig | 273/29 A |
| 4,516,771 | 5/1985 | Nau | 273/26 R |
| 4,592,545 | 1/1986 | Sagedahl | 273/26 R |
| 4,783,070 | 11/1988 | Bauer | 273/26 R |
| 4,904,199 | 9/1975 | Burchett | 273/26 R |

*Primary Examiner*—Theatrice Brown

*Attorney, Agent, or Firm*—Andsel Group, Inc.

[57] ABSTRACT

A bat swing guide apparatus is described that has a horizontal guide member, an arcuate guide member and a base. The arcuate guide member may be adjusted for the height of the batter and for a left or right-handed batter. There is a vertical locking means and an arcuate locking means to lock the bat swing guide apparatus in position. The length of the tubular member of the arcuate guide member may be measured by an angle of 90 to 180 degrees and preferably the angle will be 120 degrees. The radius of the arc may vary between 30 and 45 inches. Preferably the radius will be 36 inches. The bat swing guide apparatus shape aids the batter to emulate the swing of a successful professional batter. There is a ball holding means on the horizontal member to allow the batter to strike a ball at the completion of his guide swing. The is an angular adjustment means that enables the user to set the bat swing guide apparatus at an angle to align the batter to hit, for example, ground balls, line drives and home runs.

7 Claims, 2 Drawing Sheets

BAT SWING GUIDE APPARATUS

BACKGROUND OF THE INVENTION

1. Field of the Invention

This invention relates to a guide to train a batter to pattern his swing in a manner so as to emulate a successful professional batter's swing.

2. Description of the Related Art

Many of the devices developed in the past trained the batter to guide his bat using swing theory as known at that time. Since the true nature of a consistently, successful hitter was not known, the guides helped but generally fell short of their goal. The present invention was discovered through detailed research that utilized slow motion video photography to reveal the true nature of a successful swing structure.

U.S. Pat. No. 2,985,452 to W.A. Trippet on May 23, 1961 for a Batting Practice Apparatus is constructed to follow the "level swing" theory. It does not address the "approach" or "follow-through" portions of the swing. The batter is required to swing between the two horizontally parallel bars and is not to allow his bat to contact the bars. Non-contact with the bars is difficult and causes the batter discomfort and tension. The batter, therefore, "tenses-up" mentally and physically instead of addressing the ball in a relaxed manner. The configuration and location of the vertical support bars creates a problem because the batter may strike the bar when his arms extend during the swing. U.S. Pat. No. 3,482,838 to S.H. Gibson, et al. on Dec. 9, 1969 describes a Golf Swing Training Device. The device has a pair of stationary rails mounted on a platform. The practicing golfer is to keep his club between the two rails to improve his swing. Touching the rails indicates an improper swing. The guide of the present invention allows the batter to rest his bat on the guide and obtain the "feel" of a proper swing while concentrating on the ball. The present guide is therefore a positive feed-back apparatus as it guides the user in the proper swing and does not indicate an improper swing as does the Gibson device.

U.S. Pat. No. 3,711,103 to Ralph D. Seltzer on Jan. 16, 1973 shows a Golf Swing Guide having arcuate track members to guide a golf club through a grooved swing. The golf club is rigidly attached to a "car" that follows a trackway formed in a predetermined swing arc.

U.S. Pat. No. 3,940,131 to Ebba J. St. Claire, Jr. on Feb. 24, 1976 shows a Batting practice device for determining whether a batter has a "level" swing relative to a strike zone. The bat of the batter must pass through the two parallel horizontal bars in order to hit the ball. This device is not concerned with the approach or the follow-through portions of the swing. It is concerned only with the "contact" segment. The guide of the present invention conditions and guides the user in the approach, the contact and the follow-through segments of a swing. All of which are important to training a consistent, successful hitter.

U.S. Pat. No. 4,105,204 to Wilbur V. Koenig on Aug. 8, 1978 describes a Tennis Stroke Practice Device. A rod describing the preferred approach to a ball is mounted on a stand. The practice racquet has no strings, The user never experiences actually hitting a ball and is not allowed to "follow-through". He is instructed to not allow the racquet to touch the bar as touching it would indicate an improper swing. The guide of the present invention positively reinforces the user by providing a place to rest the bat and let the user get the "feel" of the proper location without having to constantly keep eye contact with the bat and guide.

The bat swing guide of the present invention allows the user to focus his attention on the ball and more realistically stimulates actual play.

SUMMARY OF THE INVENTION

The present invention is a bat swing guide apparatus to train a batter to consistently emulate a successful batter's swing. Especially useful for youngsters, the present invention allows an inexperienced batter to learn a proper swing from the beginning. Most of the time an inexperienced batter learns by trial and error and will likely learn to swing incorrectly. Sometimes a coach can train a batter to swing better. But, often, the coach's only tool is the accepted but obsolete manner of teaching known as the "level swing" method. The present invention provides coaches an adjustable teaching tool to eliminate bad habits and adjust incorrect swings. Some batter's acquire a proper swing naturally and their batting average shows it. However, during a long season, even a professional batter will have a hitting slump. The present invention allows accomplished batters to regain their proper swing. In operation, the bat swinging guide apparatus is adjusted to the proper height for the batter and is positioned for a left or right-handed batter. The guide is vertically adjustable on the vertical center column. There is a spring-loaded pin that is inserted into the adjustment holes to lock the vertical center column at a preselected position. The arcuate guide member has a plurality of positions. Some are for left-handed batters and some are for right-handed batters. There is another spring-loaded locking pin that is inserted into a pair of holes that lock the arcuate guide member into the selected position. There is a ball holding means, on the horizontal member of the bat swing guide apparatus, to position a ball. This allows the batter to "feel " the proper swing and receive the gratification of striking a ball. This provides a positive feedback to the user. There is a "follow-through" portion on the horizontal guide member that encourages the batter to continue the "follow-through" of their swing after ball contact. "Follow-through" is an important part of a successful swing.

There is a sliding support member on the base to position the apparatus to allow the batter to hit grounders or fly balls. A low, support position produces a downward swing and results in the batter hitting a ground ball. If the sliding support member is placed on a high, support position, an upward swing is produced and results in the batter hitting a fly ball or perhaps a home run. The vertical support member curves outward from the base and the horizontal guide member. This curve reduces the chance of the batter hitting the vertical member with the bat. A straight vertical member, as described in the related art discussed above, is more often struck by the batter. Striking the vertical member tends to have a negative effect on the batter's ability to learn to swing properly. The curtain or barrier means, shown in the present invention, provides a feeling of security to young batters. It also provides an in depth "follow-through" path that aids the batter to physically follow the swing and to psychologically project the swing in his mind. The curtain is symmetrical lengthwise to allow the curtain to be used on the apparatus when the apparatus is placed in either the right or left-handed batting positions. The curtain generally extends fron the area of the vertical support member to approximately the distal end of the arcuate guide member.

A bat swing guide apparatus has a horizontal guide member and an arcuate guide member adjustably attached to the horizontal guide member. There is an arcuate guide member locking means to lock the arcuate guide member in a plurality of positions on the horizontal guide member. The apparatus has a vertical support member with one end attached to the horizontal guide member to support the horizontal guide member and has the other end adjustably attached to an upright portion of a base. There is a vertical locking means to support and lock the arcuate guide member at a plurality of selected heights relative to the base.

The arcuate guide means may have a tubular member longitudinally formed into an arc of a circle. The length of the arc formed by the curved tubular member may have a length L, where L is a length of an arc described by angle A selected from a group of angles of 90 degrees to 180 degrees whose apex is at X and L extending from the end of the tubular member attached to the horizonal guide member to a distal end of the tubular member. A curvature of the arc L is described by a radius R, where R is a radius selected from a range of radii from 30 inches to 45 inches radiates from X and has a distal end that terminates at the arc L (tubular member).

The arcuate guide member locking means may have at least one port in the arcuate guide member and a plurality of second ports in the horizontal guide member. There may be a first pin removably inserted through one of the first ports and through one of the second ports to support and lock the arcuate guide member in a selected position relative to the horizontal guide member. There may be a first spring placed on a shaft of the first pin to bias the pin to an inserted position. The first spring may be retained in a first spring housing attached to the arcuate guide member.

The vertical locking means may have a plurality of third ports in the vertical support member spaced along the longitudinal axis of the vertical support member and at least one fourth port in the upright portion of the base. There may be a second pin removably inserted through one of the fourth ports and through one of the third ports to support and lock the arcuate member at a selected height relative to the base. A second spring may be placed on a shaft of the second pin to bias the pin to an inserted position. The second spring may be retained in a second spring housing attached to the upright portion of the base.

There may be a longitudinal portion attached to the upright portion of the base and a lateral portion removably attached to the longitudinal portion. The lateral portion is removable from the longitudinal portion in order to facilitate shipping, transportation and storage. An angular adjustment means is slidingly engaged on the longitudinal portion and there is a plurality of indicia on the longitudinal portion indicating preselected positions for the angular adjustment means to assist an angle of the longitudinal portion. The indicia may indicate a position for hitting the ball for ground balls, for line drives and for home runs. The angle A of the tubular member may be 160 degrees. The radius R of the arc of the tubular member may be 36 inches. There may be a barrier means removably attached to the arcuate guide member and to the horizontal guide member. There may be a ball holding means on the horizontal guide member to releasingly hold a ball.

It is an object of this invention to provide a bat swing guide apparatus that will improve the swing of a batter.

It is another object of this invention to provide a bat swing guide apparatus that may be used for batters of all ages and heights, and for left and right-handed batters.

It is another object of this invention to provide a bat swing guide apparatus to act as a batting practice instrument to develop proper swing habits and techniques.

It is yet another object of this invention to provide a swing guide apparatus that will train the user to emulate the swing of a successful, high-batting average, professional batter.

DESCRIPTION OF THE PREFERRED EMBODIMENT

Figure 1:
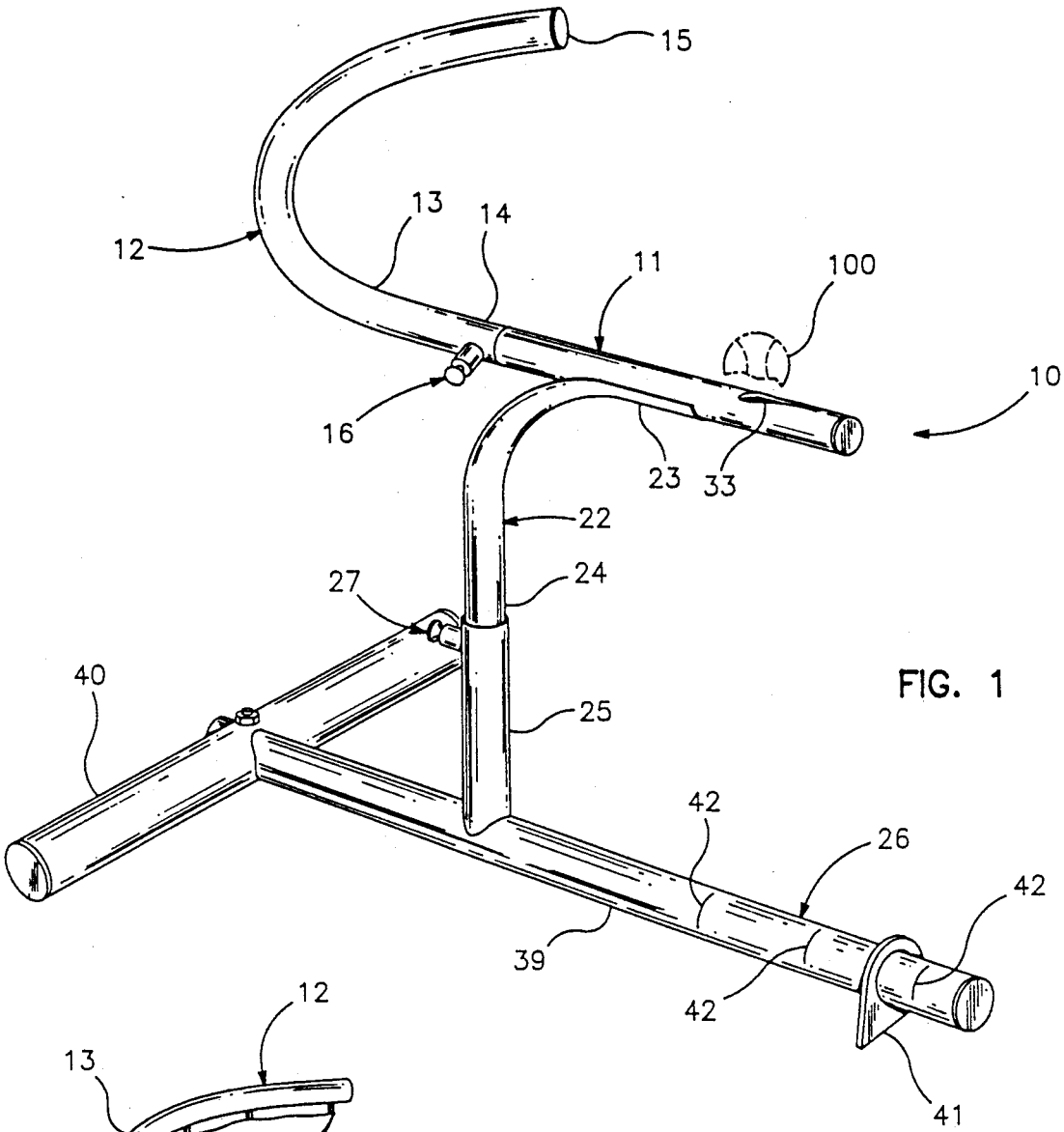
FIG. 1 is a perspective view of the bat swing guide apparatus showing the arcuate guide member in the right hand batter's postion and showing a ball in phantom.
Figure 2:
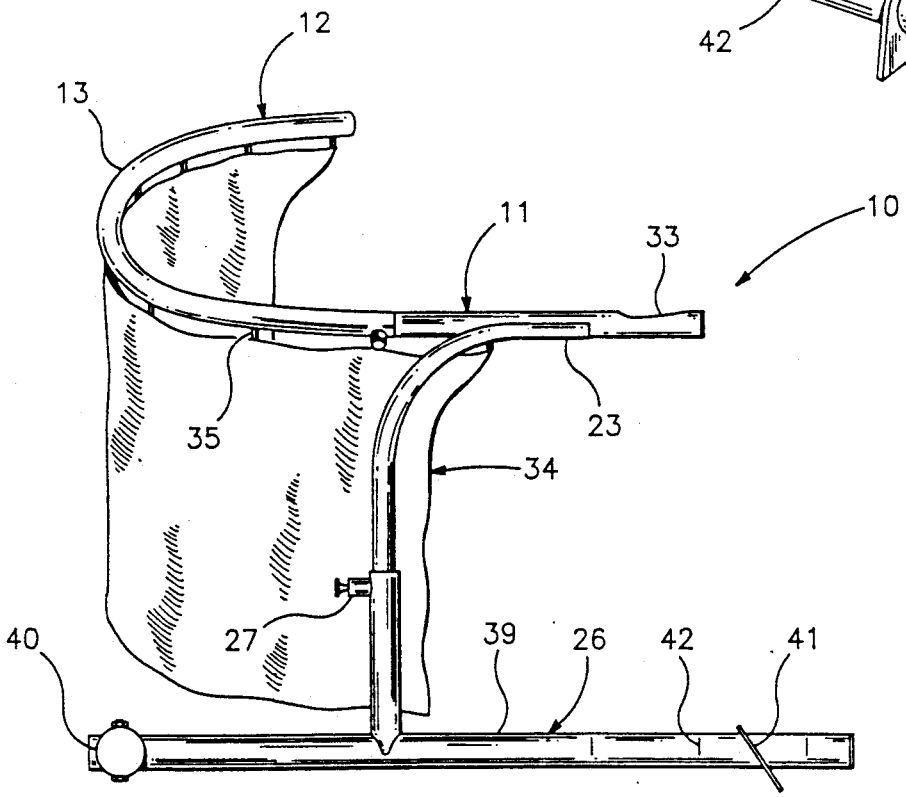
FIG. 2 is a side view of the bat swing guide apparatus showing the removable curtain/barrier means in place.
Figure 3:
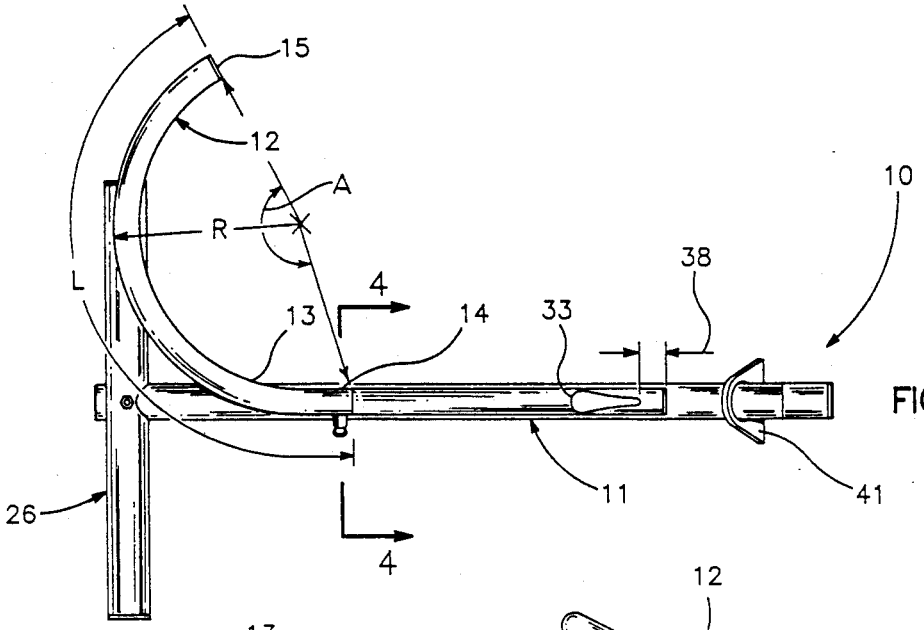
FIG. 3 is a top view of the bat swing guide apparatus.

Referring to FIGS. 1 through 6, a bat swing guide apparatus 10 is shown. The bat swing guide apparatus 10 has a horizontal guide member 11 and an arcuate guide member 12 adjustably attached to the horizontal member 11. The arcuate guide member 12 has a tubular member 13 longitudinally formed into an arc of a circle. The tubular member 13 has a length L, where L is a length of an arc described by an angle A selected from a group of angles of 90 degrees to 180 degrees, whose apex is at X, and L extending from the end 14 of the tubular member 13 attached to the horizontal guide member 11 to a distal end 15 of the tubular member 13. A curvature of the arc L is described by a radius R, where R is a radius selected from a range of radii from 30 inches radiating from X and having a distal end terminating at L to 45 inches. The angle A is preferably 160 degrees. The radius R of the arc is preferably 36inches. There is a ball holding means 33 on the horizontal guide member 11 to hold the ball 100 in position so that the batter may strike it at the completion of his guided swing. The ball holding means 33 may be an elongated hole, groove or depression, as shown in FIG. 3, in the horizontal guide member 11 shaped to hold the ball 100 in position on the horizontal guide member 11. There is a follow-through portion 38 of the horizontal guide means 11 that assists the batter to continue with a proper follow-through in his swing.

Figure 4:
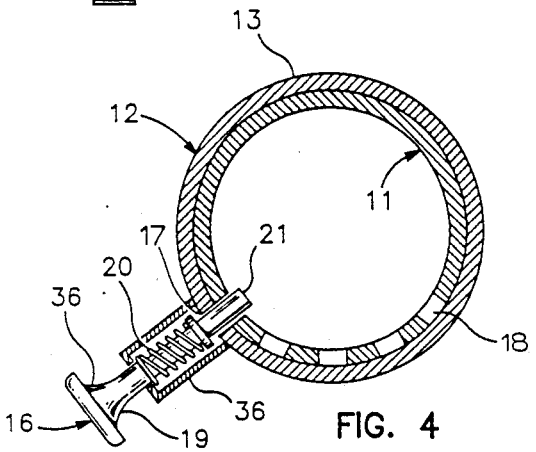
FIG. 4 is a cross-sectional view taken along lines 4—4 showing the arcuate locking means. The view shows the first pin and spring in elevation.
Figure 5:
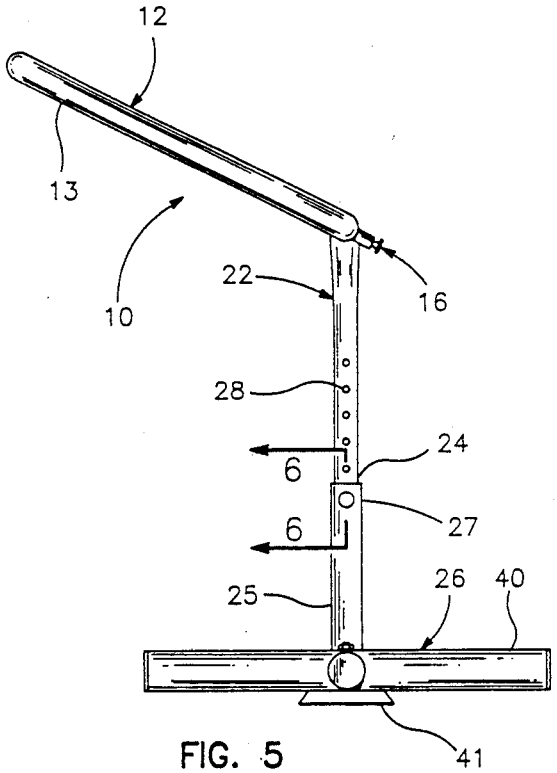
FIG. 5 is a front view of the bat swing guide apparatus.

There is an arcuate guide member locking means 16 to lock the arcuate guide member 12 in a plurality of positions on the horizontal guide member 11. The arcuate guide locking means 16 has at least one first port 17 in the arcuate guide member 12 and a plurality of second ports 18 in the horizontal guide member 11. A first pin 19 is removably inserted through one of the first ports 17 and through one of the second ports 18 to support and lock the arcuate guide member 12 in a plurality of selected positions relative to the horizontal guide member 11. A first spring 20, in housing 36, is placed on a shaft 21 of the first pin 19 to bias the first pin 19 to an inserted position as shown in FIG. 4. The is a first spring housing 36 to retain the first spring 20.

Figure 6:
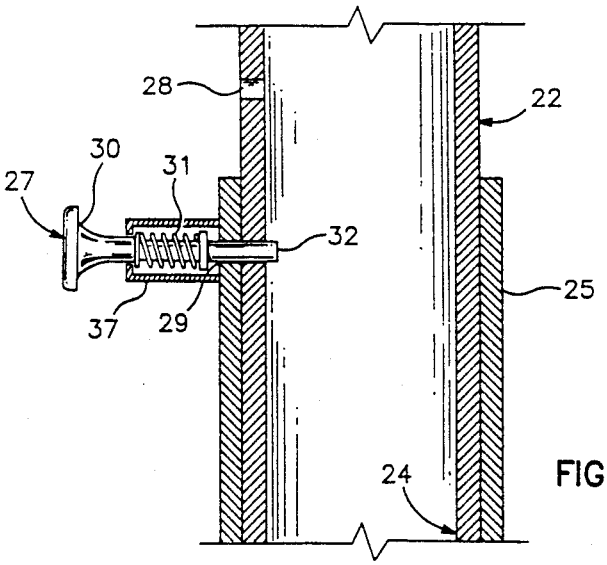
FIG. 6 is a partial sectional view showing the vertical means with the second pin and spring shown in elevation.

A vertical support member 22 has one end 23 attached to the horizontal guide member 11 to support the horizontal guide member 11 and has the other end 24 adjustably attached to an upright portion 25 of a base 26. There is a vertical locking means 27 to support and lock the arcuate guide member 12 at a selected height relative to the base 26. The vertical locking means 27 has a plurality of third ports 28 in the vertical support member 22 spaced along the longitudinal axis of the vertical support member 22. There is at least one fourth port 29 in the upright portion 25 of the base 26. A second pin 30 is removably inserted through one of the fourth ports 29 and through one of the third ports 28 to support and lock the arcuate member 12 at a selected height relative to the base 26. There is a second spring 31 placed on a shaft 32 of the second pin 30 to bias the second pin 30 to an inserted position as shown in FIG. 6. The spring is retained in the second spring housing 37. A removable curtain or barrier 34 is shown in FIG. 2. The barrier 34 can be made of cloth or a similar material or may be made of a stiffer material if desired. The barrier 34 may or may not be placed on the apparatus depending on the user. The barrier 34 is supported by removable support means 35. The removable support means may be attached to the arcuate guide member 12 and horizontal guide member 11. The removable support means 35 may be magnetic connectors.

The bat swing guide apparatus 10 may have a longitudinal portion 39 attached to the upright portion 25 of the base 26. There may be a lateral portion 40 removably attached to the longitudinal portion 39. An angular adjustment 41 means is slidingly engaged on the longitudinal portion 39.

There may be a plurality of indicia 42 on the longitudinal portion 39 that indicate preselected portions for the angular adjustment means 41 to assist in selecting an angle of the longitudinal portion 39.

The foregoing descriptions and drawings of the invention are explanatory and illustrative only, and various changes in shape, sizes and arrangements of parts as well as certain details of the illustrated construction may be made within the scope of the appended claims without departing from the true spirit of the invention.

I claim:

1. A bat swing guide apparatus comprising:

a. a horizontal guide member;

b. an arcuate guide member adjustably attached to the horizontal guide member comprising:

a tubular member longitudinally formed into an arc of a circle;

the tubular member having an arc length L, where L, is a length of an arc described by an angle A selected from a group of angles of 90 degrees to 180 degrees whose apex is at X, and L extending from the end of the tubular member attached to the horizontal guide member to a distal end of the tubular member; and a curvature of the arc L being described by a radius R, where R is a radius selected from a range of radii from 30 inches to 45 inches radiating from X and having a distal end terminating at L;

c. an arcuate guide member locking means to lock the arcuate guide member in a plurality of positions on the horizontal guide member comprising:

at least one first port in the arcuate guide member;

a plurality of second ports in the horizontal guide member;

a first pin removably inserted through one of the first ports and through one of the second ports to support and lock the arcuate guide member in a selected position relative to the horizontal guide member;

a first spring placed on a shaft of the first pin to bias the pin to an inserted position; and the first spring retained in a first spring housing attached to the arcuate guide member;

d. a vertical support member having one end attached to the horizontal guide member to support the horizontal guide member and having the other end adjustably attached to an upright portion of a base; and e. a vertical locking means to support and lock the arcuate guide member at a plurality of selected heights relative to the base.

2. A bat swing guide apparatus as described in claim 1 wherein the vertical locking means further comprises:

a. a plurality of third ports in the vertical support member spaced along the longitudinal axis of the vertical support member;

b. at least one fourth port in the upright portion of the base;

c. a second pin removably inserted through one of the fourth ports and through one of the third ports to support and lock the arcuate member at a selected height relative to the base;

d. a second spring placed on a shaft of the second pin to bias the pin to an inserted position; and e. the second spring retained in a second spring housing attached to the upright portion of the base.

3. A bat swing guide apparatus as described in claim 1 wherein the base further comprises:

a. a longitudinal portion attached to the upright portion of the base;

b. a lateral portion removably attached to the longitudinal portion;

c. an angular adjustment means slidingly engaged on the longitudinal portion; and d. a plurality of indicia on the longitudinal portion indicating preselected positions for the angular adjustment means to assist in selecting an angle of the longitudinal portion.

4. A bat swing guide apparatus comprising:

a. a horizontal guide member;

b. an arcuate guide member adjustably attached to the horizontal guide member wherein the arcuate guide member comprises:

a tubular member longitudinally formed into an arc of a circle;

the tubular member having an arc length L, where L is a length of an arc described by an angle A selected from a group of angles of 90 degrees to 180 degrees whose apex is at X, and L, extending from the end of the tubular member attached to the horizontal guide member to a distal end of the tubular member; and a curvature of the arc L being described by a radius R, where R is a radius selected from a range of radii from 30 inches to 45 inches radiating from X and having a distal end terminating at L.

c. an arcuate guide member locking means to lock the arcuate guide member in a plurality of positions on the horizontal guide member wherein the arcuate guide locking means comprises:

at least one first port in the arcuate guide member;

a plurality of second ports in the horizontal guide member;

a first pin removably inserted through one of the first ports and through one of the second ports to support and lock the arcuate guide member in a selected position relative to the horizontal guide member;

a first spring placed on a shaft of the first pin to bias the pin to an inserted position; and the first spring retained in a first spring housing;

d. a vertical support member having one end attached to the horizontal guide member to support the horizontal guide member and having the other end adjustably attached to an upright portion of a base;

e. a longitudinal portion of attached to the upright portion of the base;

f. a lateral portion removably attached to the longitudinal portion;

g. a vertical locking means to support and lock the arcuate guide member at a plurality of selected heights relative to the base wherein the vertical locking means comprises:

a plurality of third ports in the vertical support member spaced along the longitudinal axis of the vertical support member;

at least one fourth port in the upright portion of the base;

a second pin removably inserted through one of the fourth ports and through one of the third ports to support and lock the arcuate member at a selected height relative to the base;

a second spring placed on a shaft of the second pin to bias the pin to an inserted position; and the second spring retained in a second spring housing;

h. an angular adjustment means slidingly engaged on a longitudinal portion;

i. A plurality of indicia on the longitudinal portion indicating preselected positions for the angular adjustment means to assist in selecting an angle of the longitudinal portion; and j. a ball holding means on the horizontal guide means to releasingly hold a ball.

5. A bat swing guide apparatus as described in claim 4 wherein the angle A is 120 degrees.

6. A bat swing guide apparatus as described in claim 4 wherein the radius R of the arc is 36 inches.

7. A bat swing guide apparatus as described in claim 4 further comprising a barrier means removably attached to the arcuate guide member and to the horizontal guide member.

* * * * *